United States Patent [19]

Peeler et al.

[11] 4,423,421

[45] Dec. 27, 1983

[54] SLOT ARRAY ANTENNA WITH AMPLITUDE TAPER ACROSS A SMALL CIRCULAR APERTURE

[75] Inventors: George D. M. Peeler, Chelmsford; Chester J. Hunt, Melrose; Ninalbo G. DaMocogno, Winchester; Richard J. Conti, Belmont, all of Mass.

[73] Assignee: Raytheon Company, Lexington, Mass.

[21] Appl. No.: 332,423

[22] Filed: Dec. 21, 1981

Related U.S. Application Data

[63] Continuation of Ser. No. 97,246, Nov. 26, 1979, abandoned.

[51] Int. Cl.[3] ..... H01Q 13/10

[52] U.S. Cl. ..... 343/771

[58] Field of Search ..... 343/770, 771, 876

[56] References Cited

U.S. PATENT DOCUMENTS

| | | | |
|---|---|---|---|
| 3,711,858 | 1/1973 | Reeder, Jr. | 343/771 |
| 4,038,742 | 8/1977 | Kimball et al. | 343/771 |
| 4,099,181 | 4/1978 | Scillieri et al. | 343/876 |

*Primary Examiner*—Eli Lieberman

*Attorney, Agent, or Firm*—Philip J. McFarland; Joseph D. Pannone

[57] ABSTRACT

An improved slot array antenna with a circular aperture and linear polarization is shown to be made up of a plurality of slotted waveguides having different lengths and different widths. The slots in the waveguides are positioned to optimize amplitude taper in any plane passing through the center of the array normal to the surface thereof and to maximize the number of such slots.

2 Claims, 1 Drawing Figure

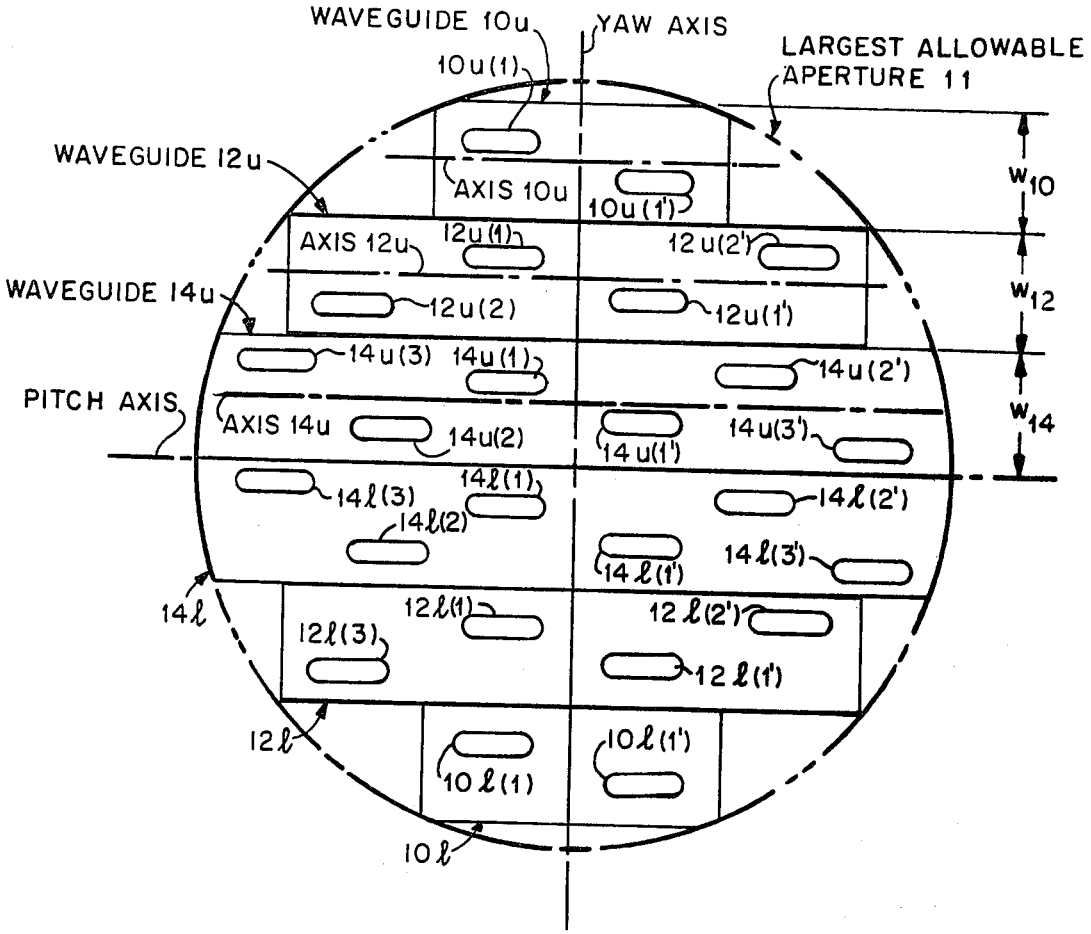
WAVEGUIDE 10u
YAW AXIS
LARGEST ALLOWABLE APERTURE 11
10u(1)
WAVEGUIDE 12u
AXIS 10u
10u(1')
$W_{10}$
AXIS 12u
12u(1)
12u(2')
WAVEGUIDE 14u
12u(2)
12u(1')
$W_{12}$
14u(3)
14u(1)
14u(2')
PITCH AXIS
AXIS 14u
14u(2)
14u(1')
14u(3')
$W_{14}$
14ℓ(3)
14ℓ(1)
14ℓ(2')
14ℓ(2)
14ℓ(1')
14ℓ(3')
14ℓ
12ℓ(1)
12ℓ(2')
12ℓ(3)
12ℓ(1')
12ℓ
10ℓ(1')
10ℓ(1)
10ℓ

SLOT ARRAY ANTENNA WITH AMPLITUDE TAPER ACROSS A SMALL CIRCULAR APERTURE

CROSS-REFERENCE TO RELATED CASES

This is a continuation of application Ser. No. 97,246, filed Nov. 26, 1979, now abandoned.

BACKGROUND OF THE INVENTION

This invention pertains generally to antennas for radio frequency energy and particularly to antennas wherein a planar array of slotted waveguides is used.

It has been common practice in the art of designing radar antennas for seekers in guided missiles to use a so-called resonant slot array. According to known practice, such an array is formed by mounting a plurality of similarly dimensioned slotted rectangular waveguides in proximity with one another to cover a predetermined aperture. An electrical short circuit is formed across one end of each waveguide to make a resonant structure wherein standing waves may exist to optimize the energization of the slots. A corporate feed of conventional design then is connected to the second ends of the waveguide to allow operation of the resonant slot array either as a transmitting antenna or a receiving antenna, such as a monopulse antenna. An example of the arrangement of the slots in a known slotted array is shown in U.S. Pat. 4,038,742.

Ordinarily, when a resonant slot array is to be used in a guided missile, it is necessary that: (1) a broadside pencil beam be formed so that antenna gain is maximized, with sidelobe levels as low as possible; and (2) the energy in the beam be linearly polarized, with cross-polarization effects minimized. In order to achieve the foregoing in the limited space available in the cylindrical body of a guided missile, the aperture of the usual slot array is circular in shape, the array itself is mounted so as to be steerable in pitch and yaw and the orientation of all of the slots with respect to the longitudinal axes of the waveguides is maintained constant. Further, if the slot array is to be operated as a monopulse antenna, the number of waveguides and disposition of slots is such that an equal number of slots is located in each quadrant of the aperture. In addition, the constraints on any slot array which must be met to avoid grating lobes or reduction in efficiency must be observed. That is to say, for a given frequency of operation, proper attention must be given to the dimensions of the waveguides, the spacing between slots and the position of the electrical short circuit in each one of the waveguides. Thus, in a typical application wherein the aperture of an antenna in a guided missile may have a diameter of 5", a slot array for X-band may have a maximum of 20 slots when known techniques are used to design such an array. Because the antenna gain of any slot array is directly related to the number of slots, the antenna gain of the array is limited.

Another problem is encountered with the conventional slot array wherein similarly dimensioned waveguides are used. Because the positions of the slots in each waveguide (along the length of such guide) are fixed, it is difficult to produce a symmetrical pencil beam. As a result, the quality of performance of the conventional slot array varies, depending upon the direction of a target from boresight.

SUMMARY OF THE INVENTION

In view of the foregoing background of this invention, it is a primary object hereof to provide a slot array wherein, with a circular aperture, the number of slots may be increased beyond the largest number possible when known techniques are applied in the design of such an array.

Another object of this invention is to provide a slot array which incorporates a larger number of slots than heretofore deemed possible in a circular aperture and at the same time may be used as a monopulse antenna.

Still another object of this invention is to provide an improved slot array wherein the spacing between slots may be optimized to produce a symmetrical pencil beam.

The foregoing and other objects of this invention are attained generally by providing, in an array antenna, a resonant slot array having a circular aperture, a plurality of differently dimensioned slotted rectangular waveguides disposed in proximity with one another to form the circular aperture, the spacing between the slots and the position of the requisite electrical short circuit in each one of such waveguides being determined by a selected dimension of each waveguide.

BRIEF DESCRIPTION OF THE DRAWINGS

For a more complete understanding of this invention, reference is now made to the following description of the accompanying drawing wherein the single FIGURE is a plan view of an antenna according to this invention.

DESCRIPTION OF THE PREFERRED EMBODIMENT

Referring now to the FIGURE, the disposition of slots (numbered below) in waveguides 10*u*, 12*u*, 14*u*, 14*l*, 12*l* and 10*l* of an exemplary resonant slot array (intended for use at X-band in a monopulse radar in a guided missile where a largest allowable aperture 11 is circular in shape with a diameter of 5") is shown. Because the slots in waveguides 10*l*, 12*l* and 14*l* are disposed, respectively, in the same way as the slots in waveguides 10*u*, 12*u* and 14*u*, and because the dimensions of similarly numbered waveguides are the same, only the latter waveguides will be described. Also, the thickness of each wall in each waveguide and the conventional corporate feed needed have not been shown.

Starting with waveguide 14*u*, the width W14 (meaning the inside dimension of the broad wall of a rectangular waveguide) is chosen so that the cutoff frequency of the dominant $TE_{01}$ mode in such guide here is near the low end of X-band. The thickness (not shown but meaning the inside dimension of the narrow wall of a rectangular waveguide) is chosen so that the cutoff frequency of the next higher mode (the $TE_{10}$ or $TE_{20}$ mode) is above the highest frequency in the X-band. Here a conventional rectangular waveguide (having inside dimensions of 0.900"×0.400") for use at X-band is employed.

It will be recognized that the waveguide wavelength of X-band energy within waveguide 14*u* is longer than the wavelength of such energy in free space and that the slots must be spaced at distances determined by the waveguide wavelength. Even so, with an aperture 5" in diameter, with shunt slots it is still possible here to have six slots spaced at half-wavelengths (measured in the waveguide along the axis 14*u*) and an electrical short circuit spaced one-quarter wavelength from the last slot (say slot 14*u*(3')).

Slots 14*u*(3), 14*u*(1) and 14*u*(2') are spaced from each other at intervals of one wavelength along the axis 14*u*. Similarly, slots 14*u*(2), 14*u*(1') and 14*u*(3') are spaced from each other at intervals of one wavelength from each other and are interleaved at one-half wavelength intervals from slots 14*u*(3), 14*u*(1) and 14*u*(2'). In addition, slots 14*u*(1) and 14*u*(1') are equally spaced (measured along the YAW AXIS, not numbered) from the axis 14*u*; slots 14*u*(2) and 14*u*(2') are also similarly spaced; and finally slots 14*u*(3) and 14*u*(3') are also similarly spaced. It will now be recognized that the slots 14*u*(1) through 14*u*(3') constitute a linear array with amplitude taper along the PITCH AXIS, with the centerline of the beam produced by such array broadside to the waveguide 14*u* (meaning orthogonal to the plane defined by the PITCH AXIS and the YAW AXIS). Further, the first sidelobe (measured along the axis 14*u*) is determined in accordance with the selected amplitude taper.

Waveguide 12*u* here is dimensioned so that its width is less than the width of waveguide 14*u*. Therefore, the wavelength of energy in waveguide 12*u* is greater than that in waveguide 14*u*. In consequence, then, the spacing (measured along axis 12*u*) between the various slots 12*u*(1), 12*u*(2), 12*u*(1'), 12*u*(2') is greater than the spacing of the corresponding slots in waveguide 14*u*. It should be noted here that if energy is fed to the same end of waveguide 12*u* as waveguide 14*u*, the electrical short circuit (not shown) in the former would be disposed one-quarter wavelength from slot 12*u*(2') so the sense of the electric field at each pair of corresponding slots in the two waveguides would be appropriate along the YAW AXIS.

The spacing (measured along the YAW AXIS) of each one of the slots 12*u*(1), 12*u*(2), 12*u*(1'), 12*u*(2') is determined to allow an amplitude taper along the YAW AXIS (without affecting polarization). Therefore, each slot in waveguide 12*u* is at a greater distance from the axis 12*u*' than the distance of the corresponding slot in waveguide 14*u* from the axis 14*u*'.

Waveguide 10*u* is dimensioned so that at least two slots 10*u*(1), 10*u*(1') may be fitted in the zone defined by the free side of waveguide 12*u* and the line defining the largest allowable aperture 11. Here the width of waveguide 10*u* is 0.740 inches. As would be expected, because the wavelength of energy within the waveguide 10*u* is greater than the wavelength within waveguide 14*u* or 12*u*, slots 10*u*(1) and 10*u*(1') are further apart than slots 12*u*(1) and 12*u*(1') or 14*u*(1) and 14*u*(1'). Also, the position of the electrical short circuit (not shown) near slot 10*u*(1') is determined by the wavelength of the energy in the waveguide 10*u* and the senses of the electric fields at slots 10*u*(1) and 10*u*(1') are, respectively, the same as the senses of the electric fields at slots 14*u*(1) and 14*u*(1').

In order to provide a desired amplitude taper along the YAW AXIS, the amount of energy fed into each one of the waveguides 14*u*, 12*u*, 10*u*, 14*l*, 12*l*, 10*l* is adjusted in any convenient manner in the corporate feed (not shown). In addition, the positions (measured along the YAW AXIS) of slots 10*u*(1), 10*u*(1') are changed to contribute to the desired amplitude taper so that the shape of the beam along the YAW AXIS is optimized and sidelobes are reduced to a minimum.

It will now be evident to one of skill in the art that, for a slot antenna with a small (meaning in the order of 5" diameter) circular aperture when designed for X-band, the flexibility in design offered by using waveguides of different widths is advantageous. That is to say, because the relative positions of corresponding slots in the different waveguides may be adjusted without changing the orientations of such slots, antenna gain may be maximized for a pencil beam with relatively small sidelobes and without affecting the polarization of such beam. In this connection, it should be noted that the length of each slot also may be adjusted to modify the phase distribution across the aperture. With an a priori knowledge of the effect of changing the length of a resonant slot, conventional empirical techniques may be followed to adjust the phase distribution across the aperture for any particular case. Thus, as here where the width of the beam measured along the yaw axis is to be the same as the width of the beam along the pitch axis, the lengths of the slots may be changed to optimize the phase distributions along such axes. It is felt, therefore, that this invention should not be restricted to its disclosed embodiment, but rather should be limited only by the spirit and scope of the appended claims.

What is claimed is:

1. In a linearly polarized slot array antenna having a substantially circular aperture, the ratio between the diameter of such aperture and the wavelength of radio frequency energy at the design frequency of such antenna being in the order of 5:1, the improvement comprising:

(a) a first plurality of rectangular waveguides, each one of such waveguides having a narrow wall and a broad wall, dimensioned, when juxtaposed with narrow walls abutting, substantially to cover a first half of the circular aperture, the width of the broad wall of each successive one of such waveguides decreasing outwardly from the centrally located one of such waveguides;

(b) a second plurality of rectangular waveguides similarly covering the second half of the circular aperture; and (c) a plurality of radiating slots formed through the broad wall of each one of the rectangular waveguides, such slots being parallel one to another with the center of each different slot lying in a plane of maximum electric field within its corresponding rectangular waveguide.

2. The improvement in a linearly polarized slot array antenna as in claim 1 wherein the distances from the longitudinal axis of successive rectangular waveguides to centers of corresponding slots increase to provide amplitude taper along a line orthogonal to the lengths of such resonators.

* * * * *